US005791186A

United States Patent [19]

Nishida et al.

[11] Patent Number: 5,791,186

[45] Date of Patent: Aug. 11, 1998

[54] PRESS WORKING METHOD FOR PLATE MATERIAL AND PRESS WORKING APPARATUS USING THE SAME

[75] Inventors: Terumi Nishida, Nukata-gun; Hideki Fukuyama, Okazaki, both of Japan

[73] Assignee: Denso Corporation, Kariya, Japan

[21] Appl. No.: 756,259

[22] Filed: Nov. 25, 1996

[30] Foreign Application Priority Data

Nov. 30, 1995 [JP] Japan ..... 7-313195

[51] Int. Cl.[6] ..... B21D 28/26; B21J 13/08

[52] U.S. Cl. ..... 72/337; 72/339; 72/404; 72/446

[58] Field of Search ..... 72/446, 447, 442, 72/404, 405.06, 339, 336, 337

[56] References Cited

U.S. PATENT DOCUMENTS

| | | | |
|---|---|---|---|
| 839,839 | 1/1907 | Hallowell | 72/404 |
| 4,457,160 | 7/1984 | Wunsch | 72/446 |
| 4,550,588 | 11/1985 | Abe | 72/404 |
| 4,733,552 | 3/1988 | Lefils | 72/405.06 |
| 5,417,097 | 5/1995 | Kojima | 72/404 |

FOREIGN PATENT DOCUMENTS

| | | |
|---|---|---|
| 0 100271 A1 | 2/1984 | European Pat. Off. . |
| 0 658383 A1 | 6/1995 | European Pat. Off. . |
| 6-63662 | 3/1994 | Japan . |
| A-6-99230 | 4/1994 | Japan . |
| 2051650 | 1/1981 | United Kingdom . |

OTHER PUBLICATIONS

Beam, W.D., "Selective Punching Apparatus", from Wester Electric Technical Digest, No. 58, Apr., 1980, pp. 3 and 4.

*Primary Examiner*—Daniel C. Crane

*Attorney, Agent, or Firm*—Harness, Dickey & Pierce, PLC

[57] ABSTRACT

According to the present invention, in a press die unit for performing a plurality of pressing steps on a strip-like plate material, there are provided a pair of stationary dies and a pair of movable dies. In each pair of dies, a plurality of punches and dies are equipped, and at least a part of punches or dies are lowered or lifted in a manner to be used or not used. By combining the positional adjustment of the movable dies and the increase or decrease in the number of the punches and dies for performing the press working process, a plurality of pressing steps for a pressed product are completed with a single pressing die unit even when the length of the pressed product is changed to a various kind.

13 Claims, 10 Drawing Sheets

PRESS WORKING METHOD FOR PLATE MATERIAL AND PRESS WORKING APPARATUS USING THE SAME

BACKGROUND OF THE INVENTION

1. Field of the Invention

The present invention relates to a press working method and apparatus for press working of a plate material and, more particularly, to a press working method and apparatus using the same, which are suitably applied to a press working of, for example, a tube-supporting seat plate of a heating heat exchanger in an automotive air conditioner.

2. Description of Related Art

Conventionally, in JP-A-6-99230, there has been proposed a press working apparatus for performing a press working of a tube-supporting seat plate in this type of heating heat exchanger. In this type of heating heat exchanger, the length of the tube-supporting seat plate is changed to a various kind of lengths depending on a product to be pressed. As accompanied therewith, the number of tube insertion holes to be formed in the tube-supporting seat plate is also changed to a various kind of numbers.

In the conventional apparatus as disclosed in the above-mentioned Publication, in order to perform the press working by using a common press die unit even if the length of the tube-supporting seat plate is changed, when forming a number of holes (tube insertion holes) in the tube-supporting seat plate by the press working, a strip-like plate material is fed at pitches each of which corresponds to a specified multiple (e.g., twice) of the hole interval, the specified number (e.g., twice) of holes are simultaneously formed by using the specified number of punches, and this operation is repeatedly performed to thereby form the required number of holes.

However, in the above-mentioned press working method, when the number of the tube insertion holes increases (in the above-mentioned Publication there is illustrated an example wherein the number of the holes is 28), if the strip-like plate material is fed at pitches each of which is twice as large as the hole interval, it results in that the forming of the holes by using punches is repeated even 14 times, thereby causing a problem in that the productivity of the press working deteriorates.

Also, as the material of the tube-supporting plate for this type of heating heat exchanger there is usually employed widely aluminum alloy, copper alloy or the like in view of heat conductivity, corrosion resistance, or the like. Each of these metal materials is relatively low in strength and, in addition, for the purpose of lightening the weight of the pressed plate, the thickness thereof is also made to be as small as 1 mm or so.

For this reason, when a hole is formed at a position adjacent to the position where a hole is already formed by the next press working, such a next press working has an influence on the processed hole, i.e., causing a problem in that this processed hole is deformed and the dimensional precision of the hole is deteriorated.

SUMMARY OF THE INVENTION

The present invention has been made in view of the above-mentioned respects and has an object to enable the conformation to a multiple kind of lengths of the plate material with the use of a single common press die unit and also to enhance the productivity of the press working and the dimensional precision of the press worked holes.

According to the present invention, in a press working method for pressing a plate material into a pressed product formed in a desired shape by a plurality of pressing steps using a pair of first dies disposed movably in a direction where the plate material is fed and a pair of second dies disposed adjacent to the first dies, each of the first dies and second dies being provided with a plurality of pairs of a punch and a die and at least a part of the punches or dies of each of the first dies and the second dies being adopted to be advanced or retreated, the number of pairs of the punch and the die in each of the first dies and the second dies is controlled in correspondence with a length of the pressed product by advancing or retreating a part of the punches or the dies, and the first dies is moved up to a position in correspondence to the number of the pressing steps by the second dies and the length of the pressed product. In this state, the plate material is pressed by the first dies, and then is pressed by the second dies.

By combining the positional adjustment of the first dies and the increase or decrease in the number of the punches and the dies for pressing as described above, even when the length of the pressed product is changed to a various kind of lengths, it is possible to complete the press working with the single press die unit, thereby decreasing the cost for manufacturing the press die unit.

In addition, since the shape of the pressed product can be completed in one pressing cycle, the productivity of the press working process can be improved as compared with the conventional technique. Further, there is no inconvenience that the shape of, for example, the hole already formed is deformed by the influence of the next press working performed at the adjacent position as in the conventional technique, thereby improving the dimensional precision thereof.

Also, a part of a plurality of punches or dies can be advanced and retreated, there is an advantage that, by adjusting the advancing or retreating amount of the punches or dies, it is possible for the depth of the press working to be altered without changing the press dies.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

An embodiment of the present invention will now be described with reference to the drawings.

Figure 1:
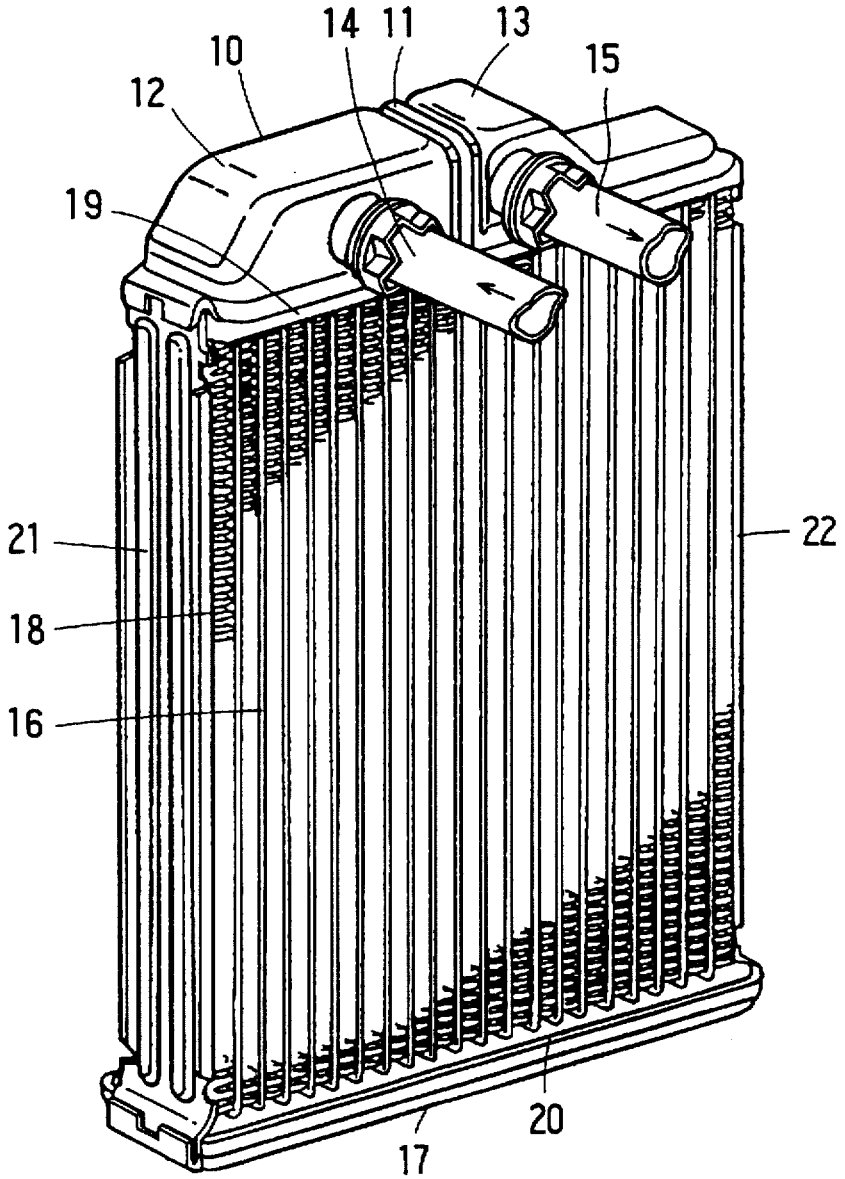
FIG. 1 is a perspective view illustrating a heating heat exchanger wherein there are adopted the parts that have been worked in accordance with a method of the present invention.

FIG. 1 illustrates a heating heat exchanger (heater core) of an automotive air conditioner, which employs the parts to be processed by a method according to the present invention. The heating heat exchanger performs heat exchange between the hot water (cooling water) from an automotive engine and a conditioned air to heat the conditioned air.

In FIG. 1, a partitioning member 11 is disposed at an intermediate position of one tank (the upper side tank in FIG. 1) as viewed in a width direction (right and left) thereof. By means of this partitioning member 11, the interior of the tank 10 is divided into two chambers 12 and 13 in the width direction. A hot water inlet pipe 14 is provided in one chamber 12 and a hot water outlet pipe 15 is provided in the other chamber 13.

In this way, the hot water that has flowed out from the hot water inlet pipe 14 to one chamber 12 of the tank 10 passes through tubes 16 of the left side half of FIG. 1 and flows into the other (lower side) tank 17. In the other tank 17, the hot water makes a U-turn and passes through the tubes 16 of the right side half of FIG. 1 and flows into the other chamber 13 of the tank 10 and flows out through the hot water outlet pipe 15 into an outside circuit. These tubes 16 are disposed in parallel with each other in a large number, and a corrugated fin is bonded between each pair of the adjacent tubes 16.

While the conditioned air passes between the tubes 16 and between the corrugated fins 18, the conditioned air is heated by receiving the heat of the hot water to thereby become a warm air. Then, the warm air is blown out into a passenger compartment.

Each of the upper and lower tanks 10 and 17 is formed in a box-like shape in which a surface on the end side of the tubes 16 is open. To the open end portions of the tanks 10 and 17 there are bonded seat plates 19 and 20, respectively. In each of seat plates 19 and 20, elliptical tube insertion holes 19*a* and 20*a* (see FIG. 2) into which the end portions of the tubes 16 are inserted and to which these end portions are bonded are formed. End plates 21 and 22 are disposed on both right/left side portions of the core portion (heat exchange portion) composed of the tubes 16 and the corrugated fins 18 and are bonded to the seat plates 19 and 20 and to the corrugated fins 18.

Each of the above-mentioned members is made of an aluminum alloy having excellent heat conductivity, corrosion resistance, brazability, or the like. These members are assembled together while being brazed integrally by way of a well known brazing method.

Figure 2A:
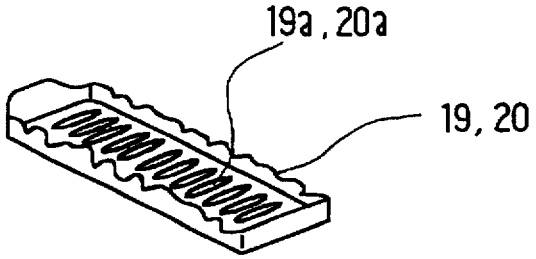
FIGS. 2A, 2B and 2C are perspective views illustrating the parts of the heating heat exchanger of FIG. 1 which have been worked in accordance with a method of the present invention.
Figure 2B:
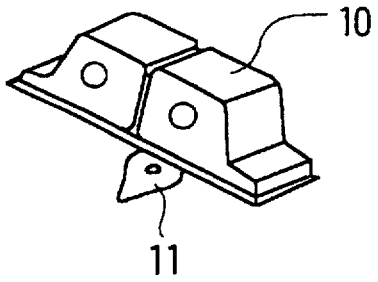
Figure 2C:
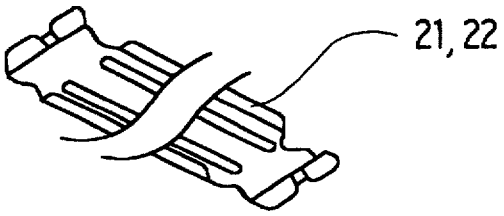

FIG. 2 illustrates, of the above-mentioned members, the seat plates 19 and 20, tank 10 and end plates 21 and 22 to be processed by the method according to the present invention. Although the lower tank 17 is not illustrated in FIG. 2, this lower tank 17 can be also processed by the method according to the present invention. This embodiment will be described as below with reference to the seat plates 19 and 20 as an example.

Figures 3A, 3B:
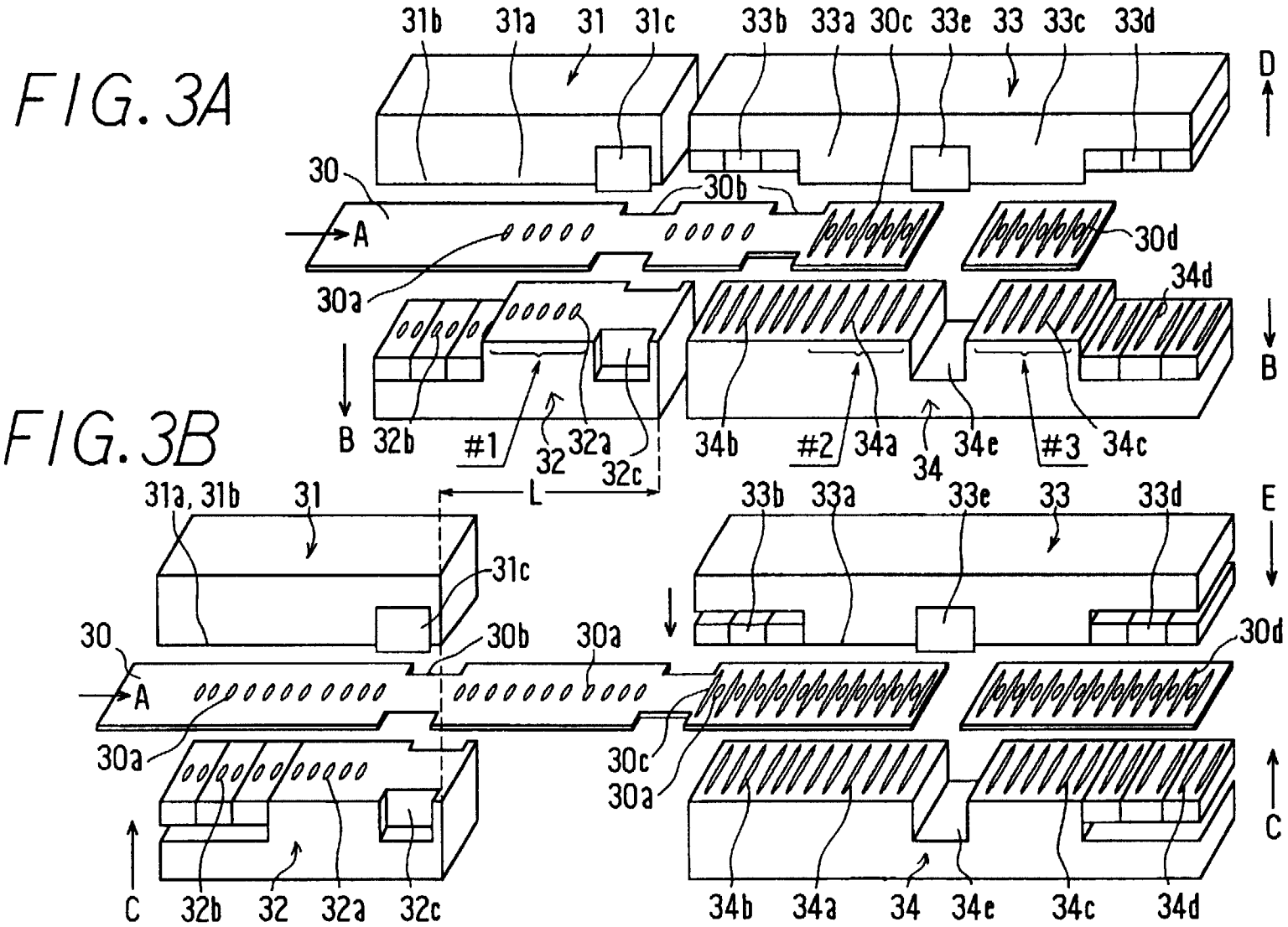
FIGS. 3A and 3B are schematic perspective views each illustrating an overall construction of an embodiment of a press working apparatus according to the present invention.

FIGS. 3A and 3B illustrate an outline of an overall construction of a press working apparatus according to the present invention. FIG. 3A illustrates a state of the press working apparatus in a case where the length of the seat plates 19 and 20 that are the objects to be processed is the smallest, namely in a case where the shortest product is processed while, on the other hand, FIG. 3B illustrates a state of the press working apparatus in a case where the length of the seat plates 19 and 20 is the largest, namely in a case where the longest product is processed.

A strip-like plate material 30 is made of an aluminum alloy which is a raw material for the seat plates 19 and 20 to be processed, and formed in a thin plate having a thickness of, for example, 1 mm. This strip-like plate 30 is fed by a feeder device (not illustrated) as indicated by an arrow A from the left to the right. A movable upper die 31 and a movable lower die 32 are movable in the right and left directions of FIG. 3, and a stationary upper die 33 and stationary lower die 34 are immovable in the right and left directions of FIG. 3. In this embodiment, the movable dies (the movable upper die 31 and movable lower die 32) are disposed at the inlet side position in the feeding direction (A) of the strip-like plate material 30 and the stationary dies (the stationary upper die 33 and stationary lower die 34) are disposed at the outlet side position in the feeding direction (A). The movable upper die 31 and the movable lower die 32 constitute a first die unit and the stationary upper die 33 and the stationary lower die 34 constitute a second die unit.

In FIG. 3A, the movable upper die 31 and movable lower are approached to the stationary upper die 33 and stationary lower die 34 with a distance L as compared with those in FIG. 3B. Here, the movable upper die 31 and movable lower die 32 form elliptical embossed ribs 30*a* and rectangular notch portions 30*b* in the strip-like plate material 30 within the range of a predetermined product length. Therefore, the movable upper die 31 is equipped therein with dies 31*a* and 31*b*, each of which has an elliptical cross section (the shape is not illustrated), for embossing and an rectangular punch 31*c* for notching while, on the other hand, the movable lower die 32 is equipped therein with punches 32*a* and 32*b*, each of elliptical cross section, and a rectangular die 32*c* which correspond to the dies 31*a* and 31*b* and punch 31*c*, respectively.

Here, the punches 32*b* constitute a part of the punches of the movable lower die 32 are advanced and retreated by the operation of an advance/retreat mechanism as described later. FIG. 3A illustrates a state where the punches 32*b* are retreated (lowered) in the direction indicated by an arrow B and FIG. 3B illustrates a state where the punches 32*b* are advanced (lifted) in the direction indicated by an arrow C.

The stationary upper die 33 and stationary lower die 34 performs a first step for punching out elliptical lower holes 30*c* which are the tube insertion holes 19*a* and 20*a* between each pair of adjacent embossed ribs 30*a* of the strip-like plate material 30, and a second step, simultaneously for burring the strip-like plate material having these lower holes 30*c* wherein the peripheral edge portions of the openings of the lower holes 30*c* are curved into circular-arc configurations, for parting the plate material at a center position of the notch portion 30b, and for bending the outer-peripheral portion of the strip-like plate material 30 by drawing.

For this reason, the stationary upper die 33 is equipped with punches 33a and 33b each having an elliptical cross section (the shape is not illustrated) for punching out the lower hole, punches 33c and 33d each having an elliptical cross section (the shape is not illustrated) for burring and a punch 33e for parting. The stationary lower die 34 is equipped with elliptical dies 34a and 34b corresponding to the punches 33a and 33b, elliptical dies 34c and 34d corresponding to the punches 33a and 33d, and die 34e corresponding to the punch 33e. The shape of the die for drawing the outer-peripheral edge portion of the strip-like plate material 30 is not illustrated.

The punches 33b and 33d of the stationary upper die 33 and the die 34d of the stationary lower die 34 are advanced and retreated by the operation of the advance/retreat mechanism as described later. FIG. 3A illustrates a state where the punches 33b and 33d are retreated (lifted) in the direction indicated by an arrow D and simultaneously the die 34d is retreated (lowered) in the direction indicated by the arrow B while, on the other hand, the punches 33b and 33d are advanced (lowered) in the direction indicated by an arrow E and simultaneously the die 34d is advanced (lifted) in the direction indicated by an arrow C.

In FIG. 3A, the symbol #1 represents a portion where an embossing/notching step for forming the embossed ribs 30a and the notch portions 30b is performed, the symbol #2 represents a hole punching step for punching out the lower hole 30c is preformed, and the symbol #3 represents a portion where a step for burring, parting, and outline-drawing the lower hole 30c is performed. A burring hole 30d which has been obtained after being burred constitutes the tube insertion hole 19a or 19b illustrated in FIG. 2.

Figure 4:
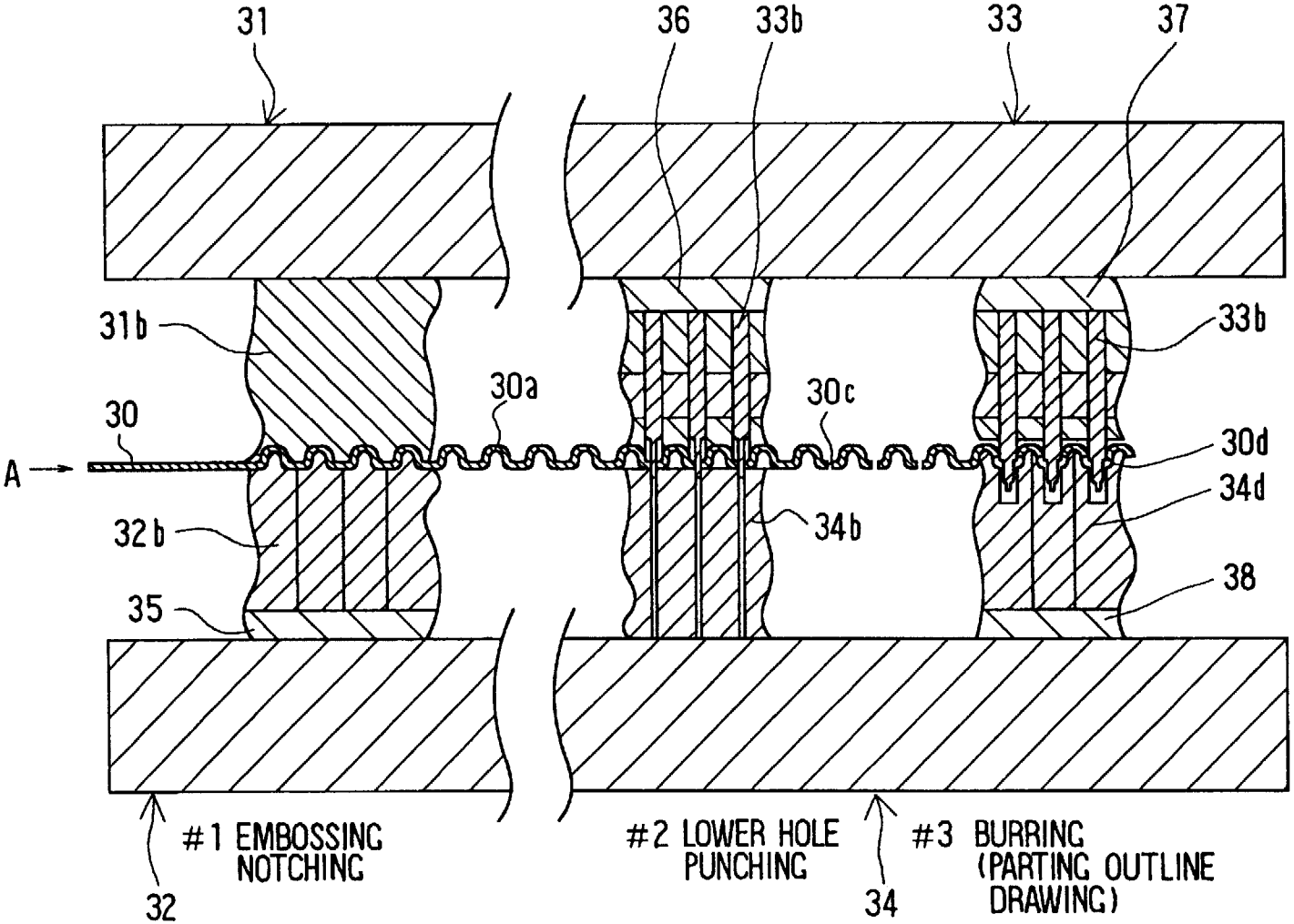
FIG. 4 is an enlarged sectional view illustrating a main portion of the press working apparatus illustrated in FIG. 3.

FIG. 4 is an enlarged cross sectional view of a main portion of FIG. 3. Each of the punches 32b, 33b and 33d and die 34d is plurally divided, and thus-divided punch pieces 32b, 33b and 33d and die pieces 34d move out and move in (advanced and retreated) independently by the operations of cam plates 35, 36, 37 and 38 of the advance/retreat mechanism.

Figure 5:
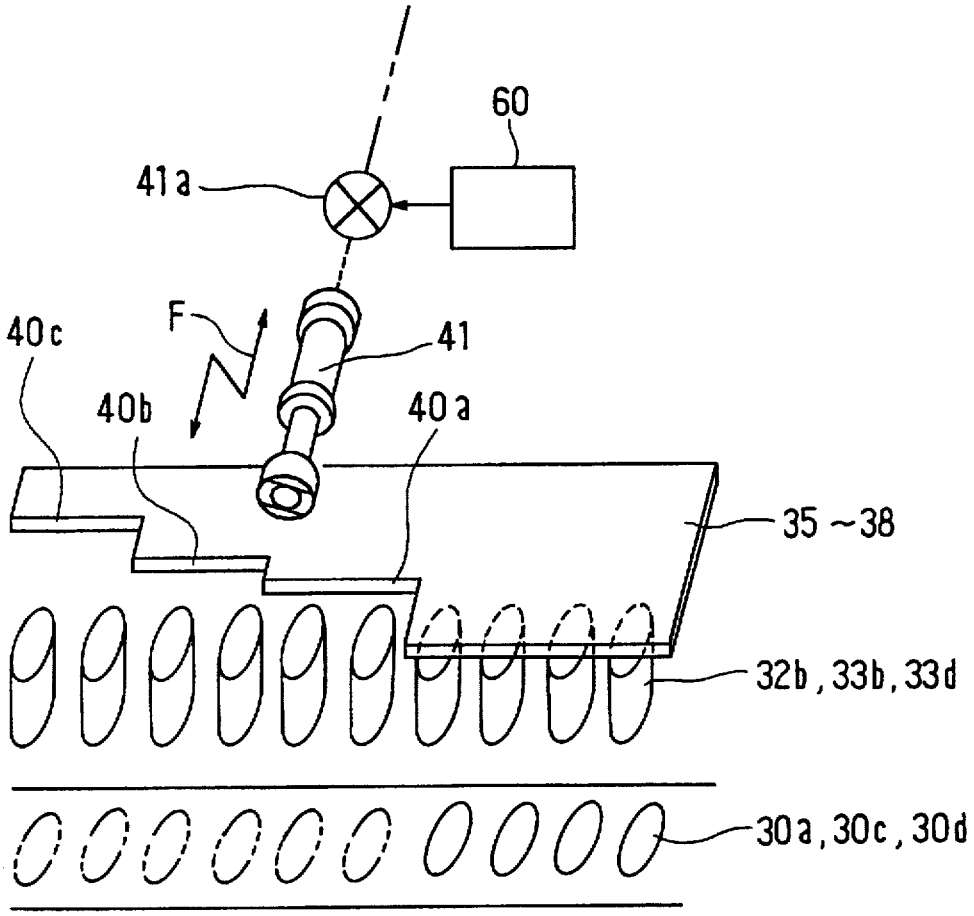
FIG. 5 is a perspective view illustrating a punch/die advance/retreat device of the press working apparatus according to the present invention.

FIG. 5 is a schematic view illustrating the operational principle of the advance/retreat mechanism. Each of the cam plates 35 to 38 is formed with stepped portions 40a, 40b and 40c in the form of a step-like shape and is advanced and retreated by a driving device 41 such as a pneumatic cylinder or the like in the directions indicated by an arrow F of FIG. 5.

In this way, the operational position of the cam plate 35 to 38 is selected by the operation of the driving device 41. Namely, when the cam plate 35 to 38 is advanced up to the operational position of FIG. 5, the right end side four punch pieces 32b, 33b and 33d can be set at the depressed position (engaged position) by the cam plate 35 to 38. Therefore, by lowering the upper dies 31 and 33 relative to the lower dies 32 and 34, it is possible to work the right end side four ribs 30a or holes 30c, 30d by means of these punch pieces 32b, 33b and 33d. Since the punch pieces other than the right end side four punch pieces are kept lifted (disengaged position) by spring means (not illustrated), even when the upper dies 31 and 33 are lowered, it is impossible to emboss the ribs or punch out the holes.

By advancing the cam plate 35 to 38 with the driving device 41 and depressing the next two punch pieces by the stepped portion 40a, the number of the ribs 30a or holes 30c and 30d to be processed can be increased with two. Since the number of the ribs 30a or holes 30c and 30d can be increased with two every time the operational position of the cam plate 35 to 38 is advanced gradually, it is possible to increase the number of the processed ribs or holes up to 4, 6, 8 and 10 gradually in the example of FIG. 5.

The operational position of the driver device 41 can be controlled by opening or closing an electromagnetic valve 41a for controlling the air pressure. The opening or closing of the electromagnetic valve 41a is controlled by the operation of an electric control circuit (control means) 60. Accordingly, it is possible to electrically control the operational position of the cam plate 35 to 38 by inputting a control signal to the electric control circuit 60 and thereby controlling the operational position of the driving device 41. As the driving device 41 may employ a servomotor instead of a pneumatic cylinder or the like.

Figure 6:
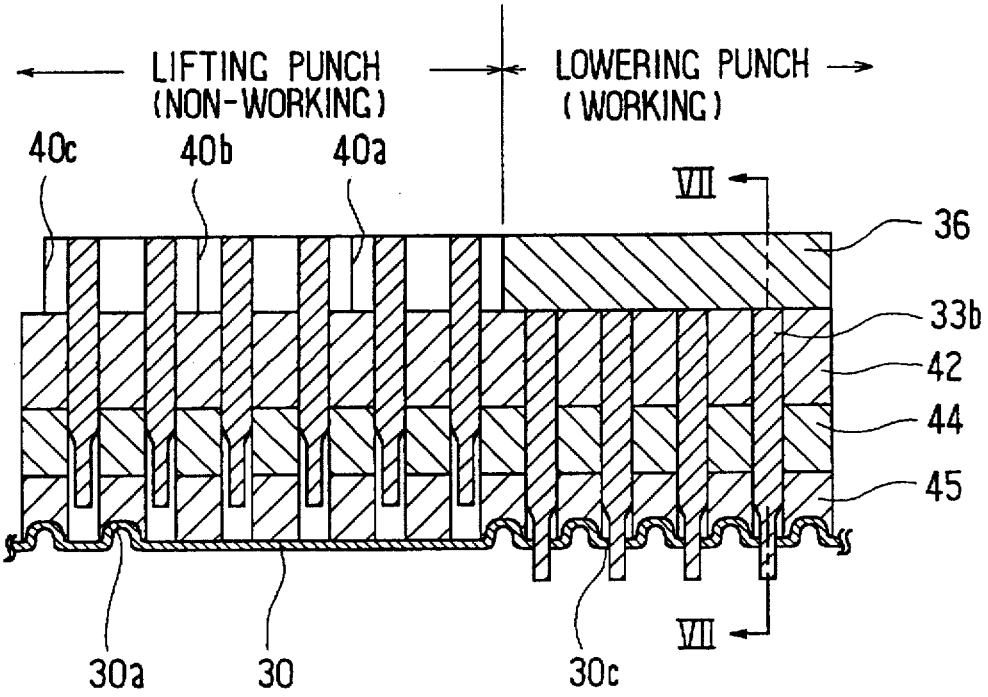
FIG. 6 is a cross sectional view illustrating the advance/retreat device for use in a lower hole punching punch according to the present invention.
Figure 7:
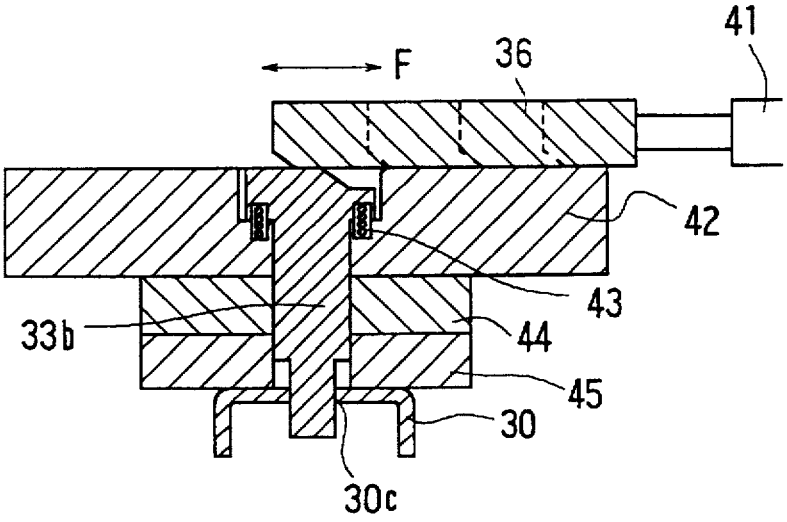
FIG. 7 is a cross sectional view taken along the line VII—VII of FIG. 6.

FIGS. 6 and 7 illustrate a concrete example of the advance/retreat mechanism for advancing or retreating the punch piece 33b of the stationary upper die 33, which is used for the hole punching step of the #2. The punch piece 33b having an elliptical cross section moves in or moves out within a punch plate 42 in the thickness direction thereof. Also, on the upper surface thereof, the cam plate 36 is advanced and retreated by the driving device 41 in the directions indicated by an arrow F in FIG. 7.

Between a head portion of the punch piece 33b and the punch plate 42 there is disposed the spring means 43 such as a coil spring, by means of which the punch piece 33b is being pressed constantly toward the cam plate 36 side (upward). For this reason, as illustrated in FIG. 7, the head portion of the punch piece 33b is depressed by the cam plate 36 while resisting the spring force of the spring means 43, only this punch piece which has been depressed downward can punch out the lower hole 30c. The lower hole 30c is punched out by a small-diameter portion of the forward end portion of the punch piece 33b. On the other hand, the punch pieces 33b (the punch pieces 33b on the left side of FIG. 6) which are not depressed by the cam plate 36, in other words, are kept lifted do not punch out the lower hole 30c.

A punch guide 44 guides the advance and retreat of the punch piece 33b, and a stripper 4 disengages the strip-like plate material from the punch piece 33b after the lower hole 30c has been punched out.

Figure 8:
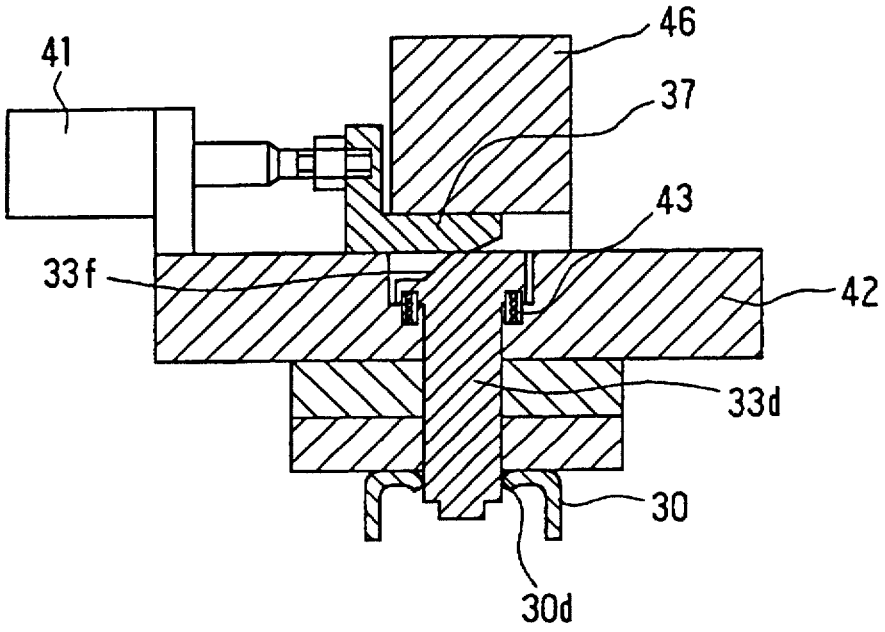
FIG. 8 is a cross sectional view illustrating a punch lowered state in the advance/retreat device for use in a burring punch according to the present invention.
Figure 9:
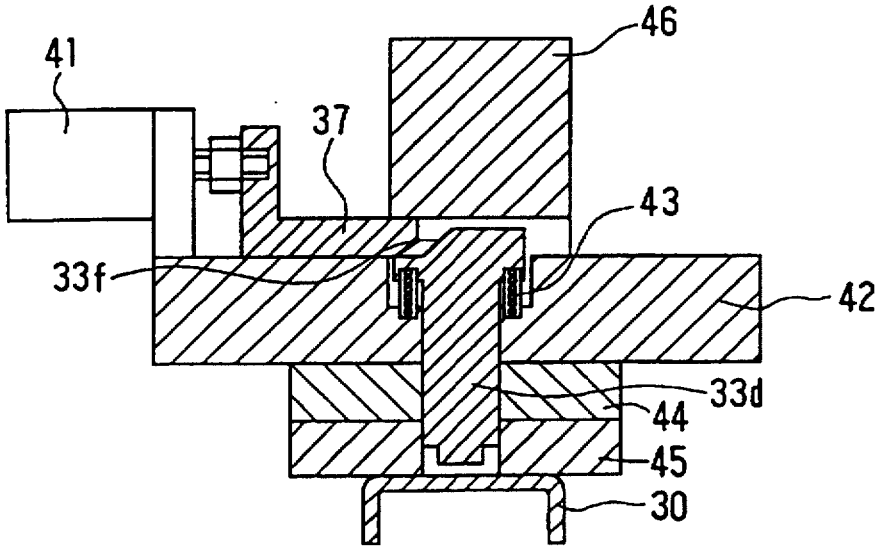
FIG. 9 is a cross sectional view illustrating a punch raised state in the advance/retreat device for use in a burring punch according to the present invention.

Next, FIGS. 8 and 9 illustrate a concrete example of the advance/retreat mechanism for advancing and retreating the punch piece 33d having an elliptical cross section in the stationary upper die 33, which is used for burring, parting and outline-drawing the lower hole 30c. Since the portions which are equivalent to those in FIGS. 6 and 7 are illustrated with the same reference numerals, and the explanation thereof is omitted. A cam guide 46 guides the movement of the cam plate 37, and is equipped integrally to the punch plate 42 together with the driving device 41 for the cam plate 37.

FIG. 8 illustrates a state where the lower hole 30c is burred by means of the punch piece 33d which has been lowered by the cam plate 36. The burring hole 30d is formed by a large-diameter portion of the punch piece 33d. The small-diameter portion at the forward end of the punch piece 33d guides the movement of the punch piece 33d into the lower hole 30c.

FIG. 9 illustrates a state where the punch piece 33d is lifted by the spring means 43 because the top of the punch piece 33d is not depressed by the cam plate 37, whereby no burring process is performed. In the example of FIGS. 8 and 9, an inclined surface 33*f* is provided on the punch piece 33*d*, and an lifted position of the punch piece 33*d* by the spring means 43 is limited by contacting the bottom portion of the inclined surface 33*f* with the cam plate 37.

Since the advance/retreat mechanism for the punch 32*b* and die 34*d* may be the same as that illustrated in FIGS. 6 to 9 as described above, the detailed explanation thereof is omitted.

Figure 10:
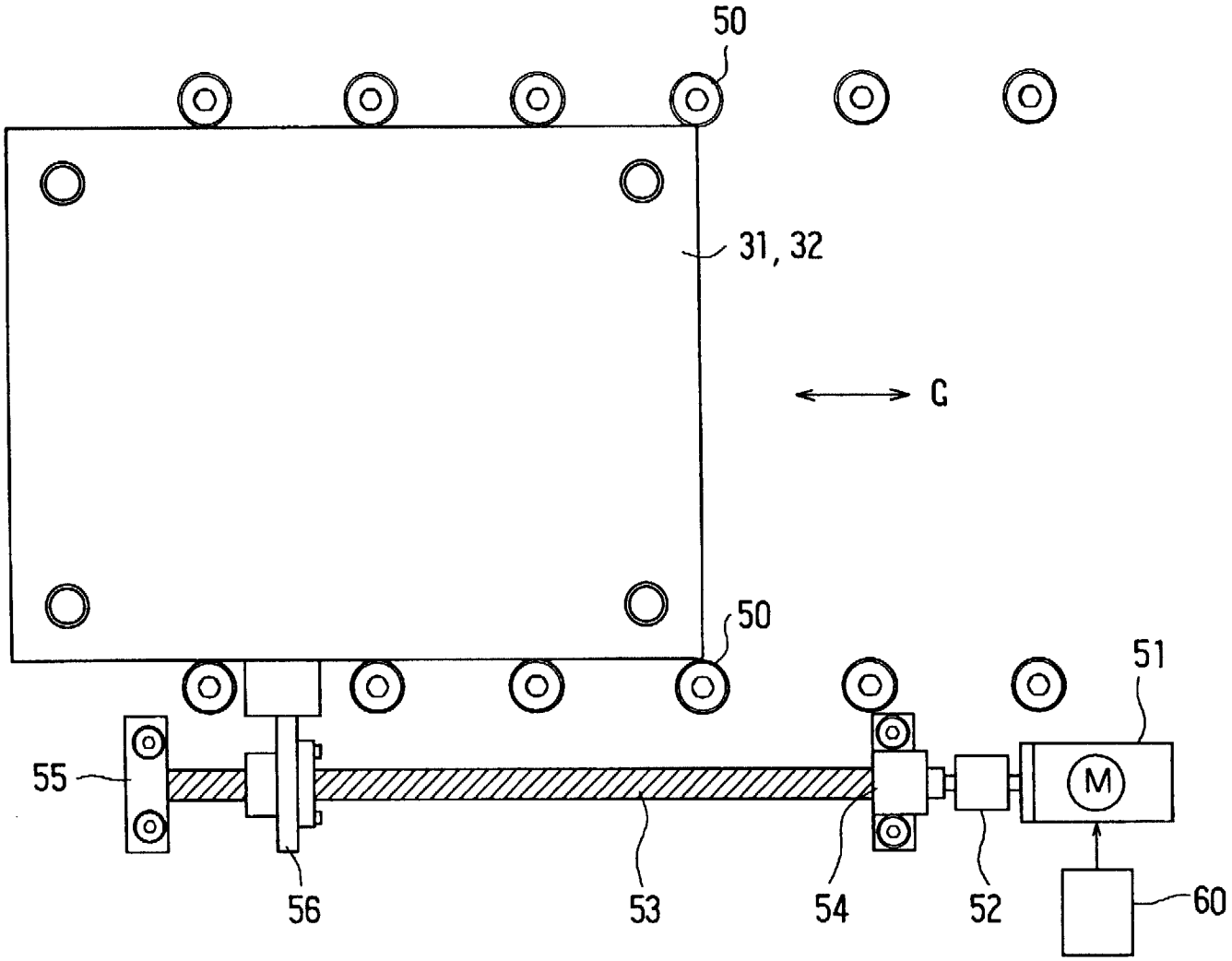
FIG. 10 is a plan view illustrating a moving mechanism for use in movable dies according to the present invention.
Figure 11:
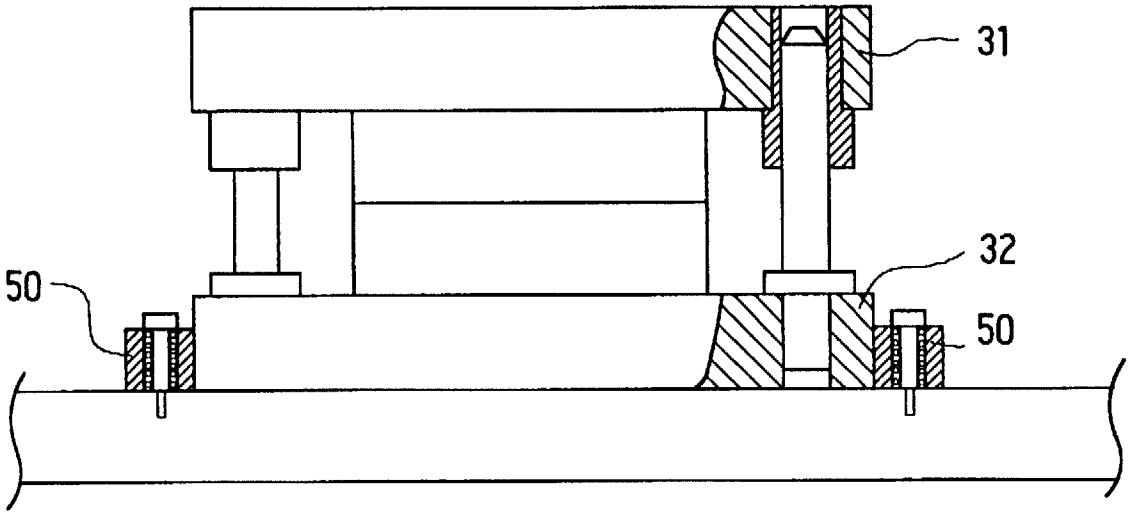
FIG. 11 is a side view illustrating the moving mechanism of FIG. 10.

Next, FIGS. 10 and 11 illustrate a moving mechanism for moving (sliding) the movable upper die 31 and movable lower die 32 in the directions indicated by an arrow G. Of the movable upper die 31 and movable lower die 32, on the moving loci of both sides of the movable lower die 32 along the sliding directions G, there are provided a plurality of rotatable guide rollers 50, by means of which the sides of the movable lower die 32 are guided. In this way, the movable upper die 31 and movable lower die 32 can slide lightly in the directions indicated by the arrow G.

A servomotor 51 is the driving source of the moving mechanism, and its rotation is transmitted through a universal joint to a ball screw 53. The ball screw 53 is rotatably supported by bearings 54 and 55 disposed on both end portions thereof. Also, there is provided a movement conversion member 56 which is engaged with the ball screw 53 and moves linearly in the directions of G by the rotation of the ball screw 53. The movement conversion member 56 is disposed at a position in a manner not as to interfere the roller members 50 and is connected integrally with the movable lower die 32.

The movement conversion member 56 may be of a known structure. For example, a nut member which is engaged with the ball screw 53 through a ball may be provided. This nut member moves linearly (reciprocates) in the directions of G by the rotation of the ball screw 53, and thereby the movement conversion member 56 reciprocatingly moves in the directions of G.

The motor 51 interlocks with the driving device 41 of the advance/retreat mechanism 41 by the output of the electric control circuit 60.

Next, in the above-mentioned construction, the press working method according to this embodiment will be described. When a control signal for press working of the shortest product is input to the electric control circuit 60, a predetermined output signal is supplied from the electric control circuit 60 to the electromagnetic valve 41*a* of the driving device 41 of the advance/retreat mechanism and to the driving motor 51 of the moving mechanism. In the moving mechanism, the movement conversion member 56 moves linearly by the rotation of the motor 51, and thereby the movable upper die 31 and movable lower die 32 are moved as illustrated in FIG. 3A up to a position so as to approach closest to the stationary upper die 33 and stationary lower die 34, respectively. Simultaneously, in the advance/retreat mechanism, the punches 32*b*, 33*b* and 33*d* and die 34*d* are lowered or lifted to the retreat positions (the positions where no press working is performed) illustrated in FIG. 3A respectively by the cam plates 35 to 38.

The position of the movable dies 31 and 32 is set at the position corresponding to the number of the pressing steps performed by the stationary dies 33 and 34 and the length of the product (the seat plates 19 and 20) formed on the strip-like plate material. That is, in this embodiment, the pressing steps performed by the stationary dies 33 and 34 includes two pressing steps of the hole punching step #2 for punching out the lower hole 30*c* and the other pressing step #3 simultaneously for burring, parting, and outline-drawing the lower hole 30*c*.

Figures 12A, 12B:
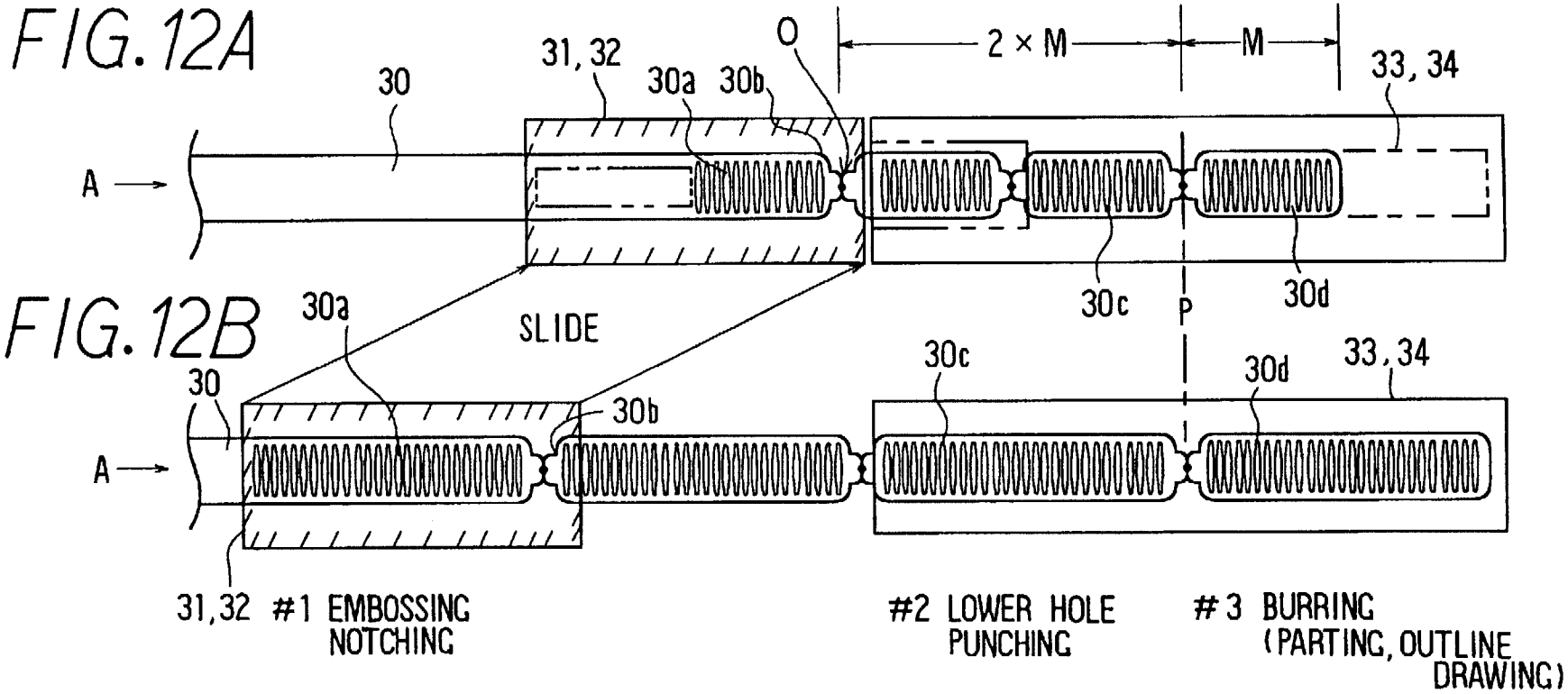
FIGS. 12A and 12B are schematic plan views illustrating the press working apparatus, which is used for illustration of the press working method according to the present invention.

The length of the product is M in FIG. 12A, and on this account, the movement position of the movable dies 31 and 32 is set so that the center line O of the product parting notch portion may be located at a position that is spaced from the center line (reference line) P of the stationary dies 33 and 34 by a distance of 2 (the pressing steps number)×M (the product length).

By setting the movement position of movement of the movable dies 31 and 32 with respect to the stationary dies 33 and 34 as described above, when the strip-like plate material 30 fed in the direction indicated by the arrow A has reached a predetermined position, the movable upper die 31 and stationary upper die 33 interlock therewith and are lowered simultaneously, and thereby the following process can be performed simultaneously.

That is, the five ribs 30*a* (the example of FIG. 3A) are punched out between the die 31*a* and the punch 32*a* of the movable dies 31 and 32, and the notch portion 30*b* is punched out between the punch 31*c* and the die 32*c*. Also, simultaneously, the lower hole 30*c* is punched out between the punch 33*a* and the die 34*b* of the stationary dies 33 and 34, and the lower hole 30*c*is burred between the punch 33*c* and the die 34*c*. Further, at the center position of the notch portion 30*b*, the strip-like plate material 30 is parted by the punch 33*e* and the die 34*e* and the outer-peripheral edge portion of the strip-like plate material 30 is bent by drawing. When the outer-peripheral edge portion of the strip-like plate material 30 is drawn, it is possible to avoid the die 34*d* from interfering with the drawing portion by retreating (lowering) the die 34*d*.

As described above, the three steps of #1 to #3 can be performed simultaneously with one cycle of pressing of the movable dies 31 and 32 and stationary dies 33 and 34 (one cycle of up/down movement of the movable upper die 31 and stationary upper die 33). With the distance corresponding to the length M of the product being employed as one pitch, the strip-like plate material 30 is fed in the direction of the arrow A with every one pitch, the shape of the product (in this embodiment, the required shape of the seat plates 19 and 20) can be completed at the position where the step of #3 is performed.

Next, when a control signal for press working of the longest product is input to the electric control circuit 60, a predetermined output signal is supplied from this control circuit 60 to the electromagnetic valve 41*a* of the driving device 41 of the advance/retreat mechanism and to the driving motor 51 of the moving mechanism. In the moving mechanism, the movement conversion member 56 moves linearly by the rotation of the motor 51 and the movable upper die 31 and movable lower die 32 are moved as illustrated in FIG. 3B up to a position in a manner as to be most apart from the stationary upper die 33 and stationary lower die 34, respectively. Simultaneously, in the advance/retreat mechanism, the punches 32*b*, 33*b* and 33*d* and die 34*d* are lowered or lifted to the advanced positions (the positions where the press working is performed) illustrated in FIG. 3B respectively by the cam plates 35 to 38.

As described above, the movement position of the movable dies 31 and 32 is set so that the center line O of the product segmenting notch portion may be located at a position that is spaced from the center line (reference line) P of the stationary dies 33 and 34 by a distance of 2 (the pressing steps number)×M (the product length). However, that in the case of FIG. 3B the product length M is twice as large as that in the case of FIG. 3A.

By setting the movement position of movement of the movable dies 31 and 32 with respect to the stationary dies 33 and 34 as described above, when the strip-like plate material 30 fed in the direction indicated by the arrow A has reached a predetermined position, the movable upper die 31 and stationary upper die 33 interlock therewith and lowered simultaneously herewith, and thereby the above-mentioned three steps of #1 to #3 can be performed simultaneously with one cycle of pressing.

Although the press working method has been described, using FIGS. 3A and 12A and FIGS. 3B and 12B, with reference to the cases where the length of the product is two in kind, i.e. the largest length and the smallest length, in even a case where the length of the product is intermediate between this largest and this smallest length, the above-mentioned three #1 to #3 steps can be also similarly performed simultaneously with one cycle of pressing by the adjustment of the number of the punch/die advancing/retreating operations and the adjustment of the movement position of the movable dies 31 and 32.

As described above, the three steps necessary for completion of the shape of the product can be performed simultaneously with one cycle of pressing, the productivity of the press working can be improved remarkably as compared with that of the conventional technique wherein the working of the holes having the same shape is repeatedly performed many times. In addition, since the shape required for the product (e.g., the required holes number) is processed at one time, there occurs no such inconvenience as that which occurs with the conventional technique wherein the already processed adjacent hole portion is deformed when the next hole process is performed, and as a result the dimensional precision can be also improved.

In the above-mentioned embodiment the method of the present invention has been applied to the press working of the seat plates 19 and 20, however, since the tank 10 illustrated in FIGS. 1 and 2, the tank 17 illustrated in FIG. 1 and the side plates 21 and 22 illustrated in FIG. 1 are formed with a plurality of pressing steps, these products can be pressed by applying the method of the present invention, and similarly it is possible to favorably cope with a multiple kind of lengths with a single press die unit.

Also, although in the above-mentioned embodiment the pressing steps for obtaining the required shape are performed with a combination of the movable dies 31 and 32 (first die set) and stationary dies 33 and 34 (second die set), both the first die set and the second die set may each be composed of movable dies.

Also, the method of the present invention is not limited to the case where a plurality of pressing steps are performed with the first and second dies and can be also applied to a case where only a single pressing step is performed.

Also, the method of the present invention is not limited to being applied to the heating heat exchanger but can be generally applied widely to the press working of metallic products.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A press working method for pressing a plate material into a pressed product formed in a desired shape by a plurality of pressing steps using a pair of first dies disposed movably in a direction generally parallel to a feed direction of said plate material and a pair of second dies disposed adjacent to said first dies, each of the first dies and second dies being provided with a first plurality of punches and dies and a second plurality of punches and dies, said second plurality of punches or dies of each of said first dies and said second dies being selectively engaged or disengaged, said press working method comprising steps of;

controlling said second plurality of punches and dies in each of said first dies and said second dies in correspondence with a length of said pressed product by engaging a selected number of said second plurality of punches or dies;

moving said first dies up to a position in correspondence to the number of the pressing steps by said second dies and the length of said pressed product;

feeding said plate material to said first dies;

pressing said plate material by said first dies; and pressing said plate material, which has been pressed by said first dies, by said second dies.

2. A press working method according to claim 1, wherein, when a first product is pressed on said plate material, said first dies are moved to a position in a manner as to be most apart from said second dies, and said second plurality of punches or dies are engaged such that a pressing is performed to press said plate material by way of said first and second plurality of punches and dies; and when a second product is pressed on said plate material, said first dies are moved up to a position in a manner as to approach closest to said second dies, and said second plurality of punches or dies is disengaged such that a pressing is not performed to press said plate material by way of said second plurality of punches and dies.

3. A press working method according to claim 1, wherein said first dies are movable dies and said second dies are stationary dies.

4. A press working method according to claim 1, wherein said plurality of pressing steps by said first dies and said second dies are performed simultaneously in one pressing cycle.

5. A press working method according to claim 4, wherein said pressing step performed by said first dies includes an embossing step for embossing a plurality of ribs on said plate material, and said pressing step performed by said second dies includes a hole-punching step for punching out a lower hole between the adjacent two ribs and a burring step for curving a peripheral edge opening portion of said lower hole into a circular arc shape.

6. A press working method according to claim 1, wherein said pressed product is used for a heating heat exchanger of an automotive air conditioner.

7. A press working apparatus for pressing a plate material into a pressed product formed in a desired shape, comprising:

a pair of first dies disposed movably in a direction generally parallel to a feed direction of said plate material, said first dies being provided with a plurality of punches and dies and an engaging and disengaging mechanism for independently engaging and disengaging at least a part of said plurality of punches or dies of said first dies;

a pair of second dies disposed adjacent to said first dies, said second dies being provided with a plurality of punches and dies and an engaging and disengaging mechanism for independently engaging and disengaging at least a part of said plurality of punches or dies of said second dies;

a moving mechanism for moving the first dies in said direction; and a control means for controlling interlockingly said moving mechanism and said engaging and disengaging mechanisms; wherein, the number of said plurality of punches and dies in each of said first dies and said second dies is controlled in correspondence with a length of said pressed product by said respective engaging and disengaging mechanism, and said first dies are moved up to a position in correspondence to the number of the pressing steps by said second dies and the length of said pressed product by said moving mechanism.

8. A press working apparatus according to claim 7, wherein, at least one of said engaging and disengaging mechanisms is provided with a cam plate which is positioned by an operation of a driving device, and the number of said plurality of punches and dies for pressing is controlled by selecting an operational position of said cam plate.

9. A press working apparatus according to claim 7, wherein, said first dies are movable dies and disposed at an inlet side of said feed direction, and said second dies are stationary dies and disposed at an outlet side of said feed direction.

10. A press working apparatus according to claim 9, wherein:

a part of said plurality of punches and dies in said first dies are located at said inlet side; and a part of said plurality of punches and dies in said second dies are located at both said inlet and said outlet sides.

11. A press working apparatus according to claim 7, wherein said first dies and said second dies perform a plurality of pressing steps simultaneously in one pressing cycle.

12. A press working apparatus according to claim 7, wherein, said first dies performs a pressing step including an embossing step for embossing a plurality of ribs on said plate material, and said second dies performs pressing steps including a hole-punching step for punching out a lower hole between the adjacent two ribs and a burring step for curving a peripheral edge opening portion of said lower hole into a circular arc shape.

13. A press working apparatus according to claim 7, wherein said pressed product is used for a heating heat exchanger of an automotive air conditioner.

* * * * *